US009916709B2

(12) United States Patent
Kondo et al.

(10) Patent No.: US 9,916,709 B2
(45) Date of Patent: Mar. 13, 2018

(54) COIN BATCH INSERTION DEVICE

(71) Applicant: NIPPON CONLUX CO., LTD., Sakado-shi (JP)

(72) Inventors: Masashi Kondo, Sakado (JP); Fumio Yuzawa, Sakado (JP); Fuminori Hongo, Sakado (JP)

(73) Assignee: NIPPON CONLUX CO., LTD., Sakado-shi (JP)

( * ) Notice: Subject to any disclaimer, the term of this patent is extended or adjusted under 35 U.S.C. 154(b) by 0 days.

(21) Appl. No.: 15/537,166

(22) PCT Filed: Oct. 26, 2015

(86) PCT No.: PCT/JP2015/080080
§ 371 (c)(1),
(2) Date: Jun. 16, 2017

(87) PCT Pub. No.: WO2016/098450
PCT Pub. Date: Jun. 23, 2016

(65) Prior Publication Data

US 2018/0005477 A1 Jan. 4, 2018

(30) Foreign Application Priority Data

Dec. 17, 2014 (JP) ..... 2014-255352

(51) Int. Cl.
*G07D 1/00* (2006.01)
*G07D 3/16* (2006.01)
*G07D 9/00* (2006.01)

(52) U.S. Cl.
CPC ..... *G07D 3/16* (2013.01); *G07D 1/00* (2013.01); *G07D 9/008* (2013.01)

(58) Field of Classification Search
CPC ..... G07D 1/00; G07D 9/008; G07D 2201/00
See application file for complete search history.

(56) References Cited

U.S. PATENT DOCUMENTS 2,251,755 A * 8/1941 Peters ..... G07D 1/00 194/249
5,125,493 A 6/1992 Abe
2003/0057644 A1* 3/2003 Shirasawa ..... G07D 9/00 273/138.1

FOREIGN PATENT DOCUMENTS

EP 0 080 858 A2 6/1983
JP 55-28113 A 2/1980
(Continued)

OTHER PUBLICATIONS

International Search Report issued Jan. 19, 2016 in PCT/JP2015/080080 filed Oct. 26, 2015 (4 pages).

*Primary Examiner* — Mark J Beauchaine
(74) *Attorney, Agent, or Firm* — Oblon, McClelland, Maier & Neustadt, L.L.P.

(57) ABSTRACT

To provide a coin batch insertion device which is capable of feeding a coin at high speed. In addition, to provide a coin batch insertion device which is capable of implementing space saving.

A coin batch insertion device 1 that separates and feeds a plurality of inserted coins C, inserted as a batch, one by one, includes: a cylindrical portion 4; a rotor 5 arranged inside the cylindrical portion 4; and a floor portion 7 including a coin dropping hole 7*a*, in which the inserted coins C, maintained in an erect state, are fed by conveying the coins between an inner peripheral wall of the cylindrical portion 4 and an outer peripheral wall of the rotor 5 along the inner peripheral wall of the cylindrical portion 4 using rotation of the rotor 5 and dropping the coins into the coin dropping hole 7*a* one by one.

5 Claims, 9 Drawing Sheets

(56) References Cited

FOREIGN PATENT DOCUMENTS

| | | | |
|---|---|---|---|
| JP | 58-92083 | | 6/1983 |
| JP | 2-6375 | U | 1/1990 |
| JP | 3-66466 | U | 6/1991 |
| JP | 7-262428 | A | 10/1995 |
| JP | 2014-191804 | A | 10/2014 |

* cited by examiner

[Fig.1]
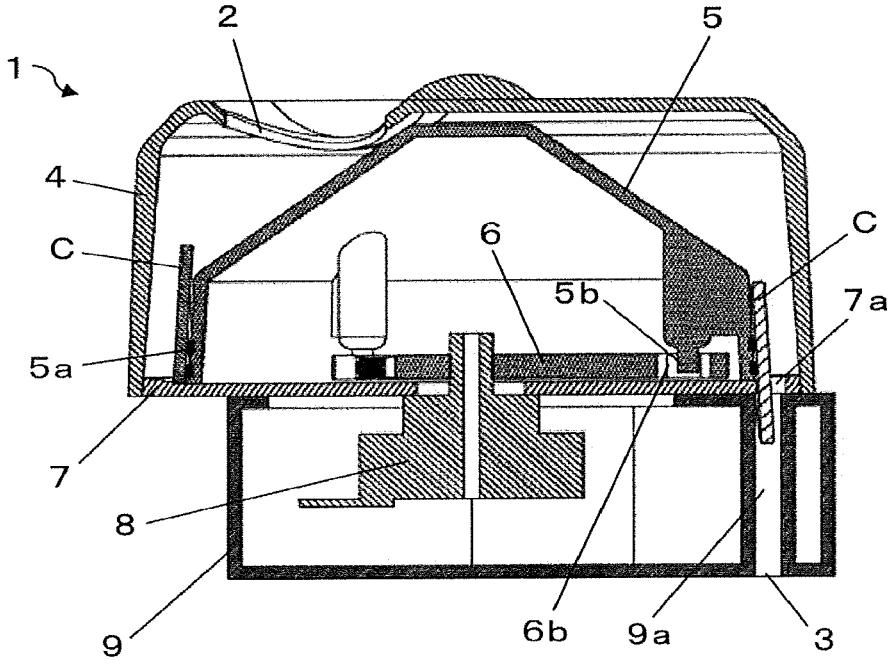

[Fig.2A]
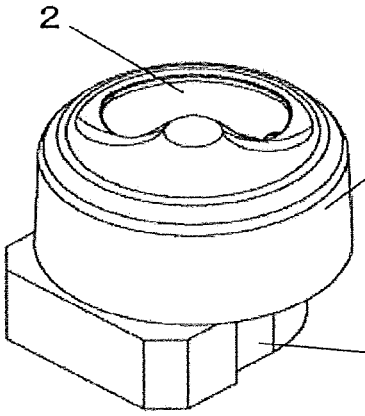
[Fig.2B]
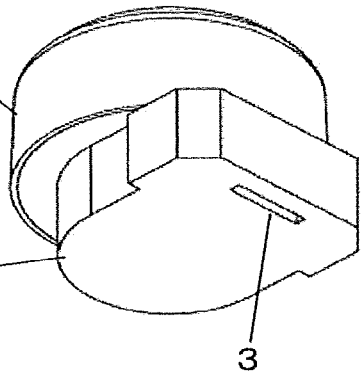

[Fig.3A]
[Fig.3B]
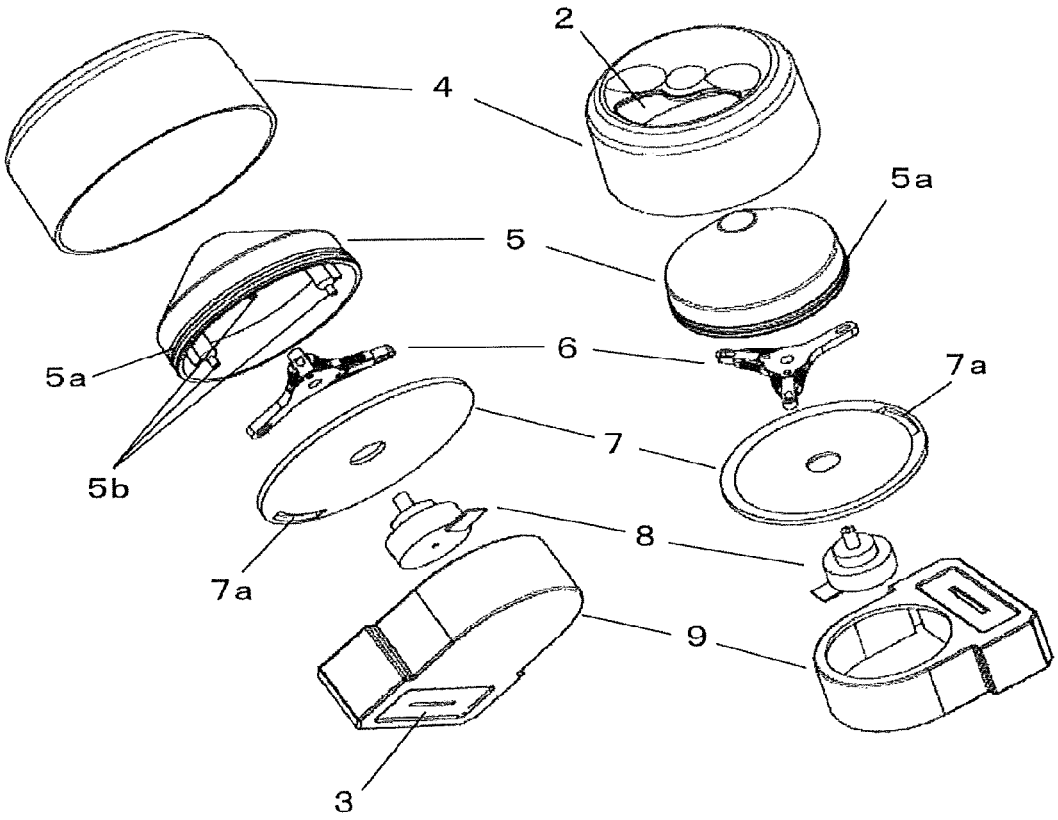

[Fig.4]
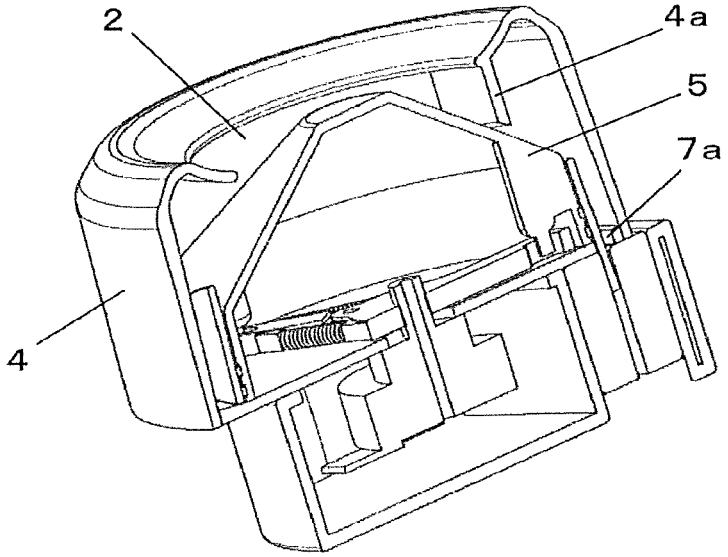

[Fig.5]
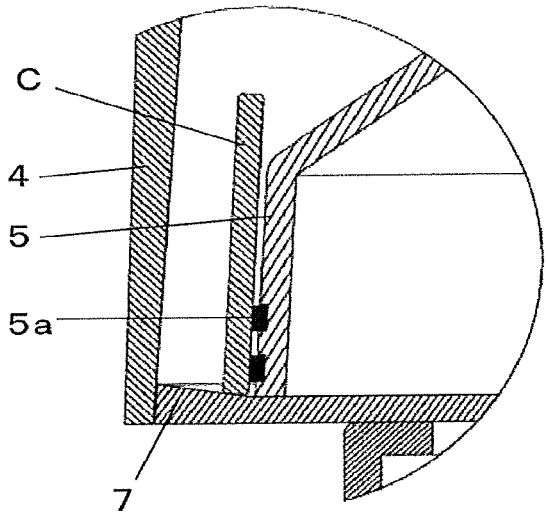

[Fig.6]
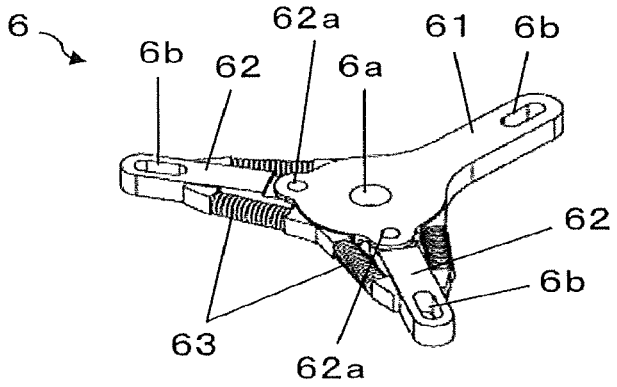

[Fig.7]
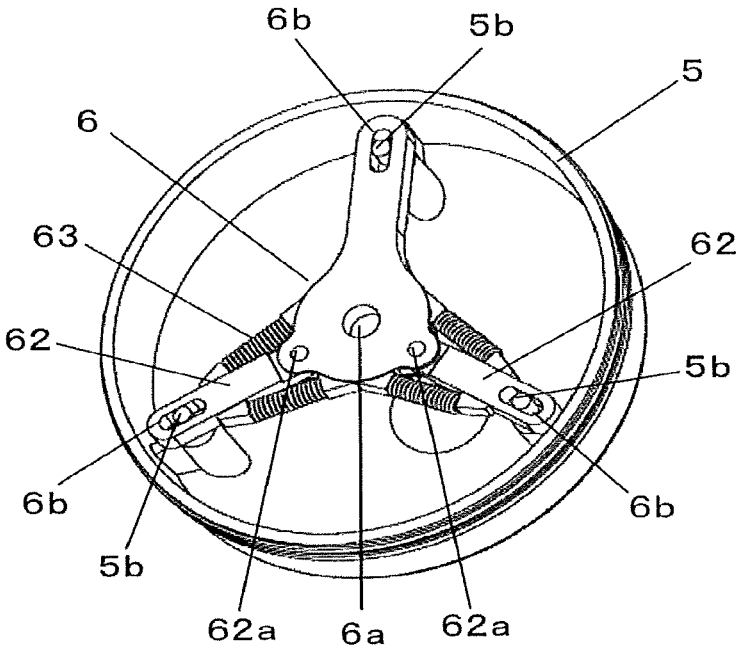

[Fig.8A]
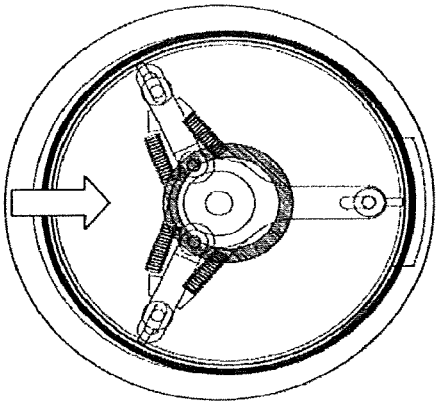
[Fig.8B]
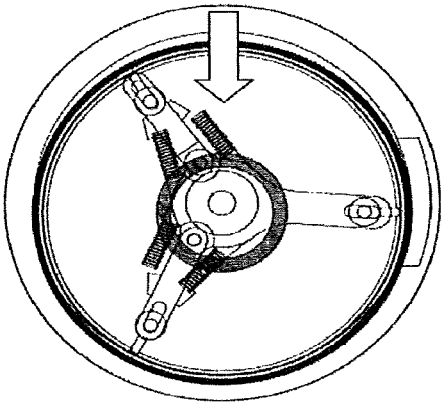
[Fig.8C]
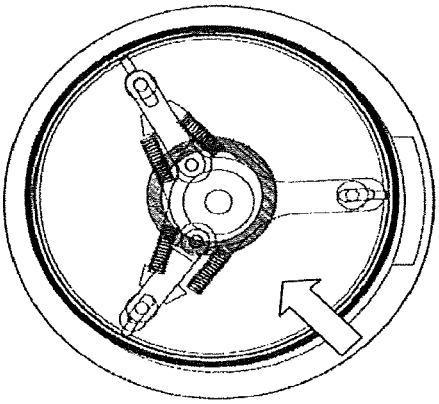

[Fig.9]
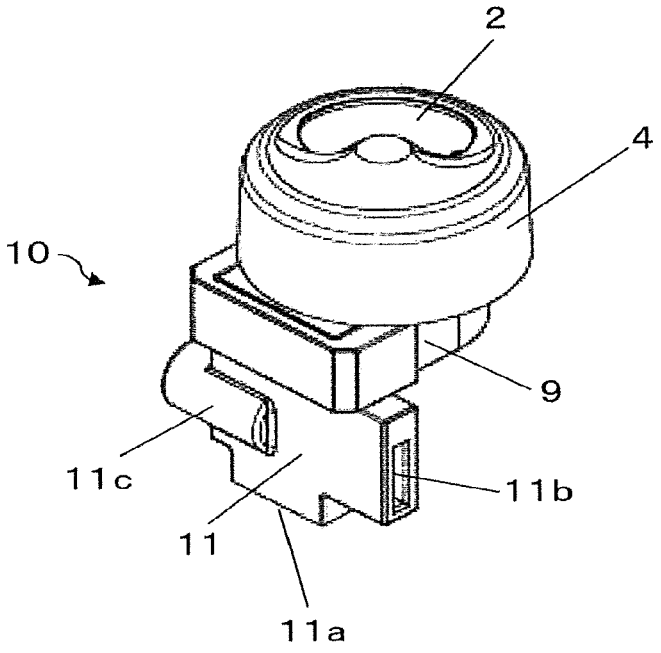

COIN BATCH INSERTION DEVICE

TECHNICAL FIELD

This invention relates to a coin batch insertion device which is a device that separates and feeds coins, which have been inserted as a batch, one by one.

BACKGROUND ART

Coin batch insertion devices are devices that receive coins in a denomination-mixed state as a batch, and then, separate and feed the received coins in the denomination-mixed state one by one. The coin batch insertion devices are generally provided with a coin identification unit at a downstream side thereof, and used for a coin counting machine that counts the number of inserted coins for each denomination. In addition, the coin batch insertion devices are generally provided with a coin identification unit, a coin sorting unit, and a coin storage unit at a downstream side thereof, and used for a coin receiving machine that stores coins for each denomination. Recently, a demand for a coin counting machine, configured to count coins for accounting in a retail store or the like, has increased, and there is a request for a coin batch insertion device which is small and capable of high-speed processing.

The coin batch insertion device generally includes a coin insertion port configured for insertion of coins, a coin retaining portion configured to temporarily retain the inserted coins, a coin feeding port configured to feed the coins to the outside one by one, and a coin feeding means configured to feed the coins retained in the coin retaining portion, one by one, to the coin feeding port. Further, there is a method of separating coins one by one using a hopper technique or a belt-conveying technique as the coin feeding means to send the coins to the coin feeding port. The hopper technique is configured to separate coins on a disk one by one using a hole or a protrusion provided in the rotating disk or to cause the coins on the disk to be biased in an outer circumferential direction and sent out to the coin feeding port using a centrifugal force generated by the rotating disk. The belt-conveying technique is configured to separate coins one by one by providing a gate through which a single coin can pass on a belt on which the coin is conveyed.

CITATION LIST

Patent Literature

Patent Literature 1: Japanese Patent Application Laid-Open No. 2014-191804 A

Patent Literature 2: Japanese Patent Application Laid-Open No. H07-262428 A

SUMMARY OF INVENTION

Technical Problem

It is necessary to wait for entering of coins into the hole or the protrusion provided in the disk in order to separate the coins one by one in the hopper technique used in the conventional coin batch insertion device, and it is necessary to provide a lot of space in the horizontal direction in the method of using the centrifugal force of the rotating disk. In addition, it is difficult to increase conveying speed of the belt, and further, it is necessary to provide a lot of space in the horizontal direction in the belt-conveying technique. Thus, there is a problem that it is difficult to obtain an additional increase in speed of feeding of the coin or power saving due to a structural restriction in the conventional coin batch insertion device.

The present invention has been made in view of the above-described problem, and an object thereof is to provide a coin batch insertion device which is capable of feeding a coin at high speed. In addition, another object is to provide a coin batch insertion device which is capable of implementing space saving.

Solution to Problem

In order to solve the above-described problems, a coin batch insertion device according to claim 1 is a coin batch insertion device that separates and feeds a plurality of inserted coins, inserted as a batch, one by one, and is characterized by including a cylindrical portion, a rotor arranged inside the cylindrical portion, and a floor portion including a coin dropping hole, and feeding the inserted coins, maintained in an erect state, to be conveyed between an inner peripheral wall of the cylindrical portion and an outer peripheral wall of the rotor along the inner peripheral wall of the cylindrical portion using rotation of the rotor and to be dropped into the coin dropping hole one by one.

A coin batch insertion device according to claim 2 is the coin batch insertion device according to claim 1, and is characterized in that the inner peripheral wall of the cylindrical portion and the outer peripheral wall of the rotor are inclined toward a center portion, and the floor surface portion is inclined to descend toward the center portion.

A coin batch insertion device according to claim 3 is the coin batch insertion device according to claim 1 or 2, and is characterized in that a rotation center of the rotor moves in a direction opposite to a location where clogging of the inserted coins occurs when the clogging of the inserted coins occurs.

A coin batch insertion device according to claim 4 is the coin batch insertion device according to claim 3, and is characterized by including a driving motor and a rotor support portion. The rotor support portion is configured of a central portion to which a rotation shaft of the driving motor is fixed and three or more arms extending from the central portion. One of the arms is a reference arm which is integrated with the central portion, and the other arms are additional arms which are attached to the central portion to be rotatable and biased to be at specific positions when an external force is not applied. Engagement holes each of which has a slit shape that is long in a center direction are provided near distal end portions of the respective arms. Engagement protrusions, configured to be engaged with the engagement holes, are provided at a bottom portion of the rotor.

A coin counting device according to claim 5 is a coin counting device that counts the number of a plurality of inserted coins, inserted as a batch, and is characterized by including a cylindrical portion, a rotor arranged inside the cylindrical portion, a floor portion including a coin dropping hole, and a coin counting means arranged at a downstream side of the coin dropping hole, and conveying the inserted coins maintained in an erect state between an inner peripheral wall of the cylindrical portion and an outer peripheral wall of the rotor along the inner peripheral wall of the cylindrical portion using rotation of the rotor, and dropping the coins into the coin dropping hole to be fed out one by one such that the fed-out inserted coins are counted by the coin counting means.

Advantageous Effects of Invention

According to the present invention, it is possible to increase processing speed of the coin batch insertion device. In addition, it is also possible to implement the space saving of the coin batch insertion device.

BRIEF DESCRIPTION OF DRAWINGS

FIG. 1 is a cross-sectional view of a main part of a coin batch insertion device according to an embodiment of the present invention.

FIGS. 2A and 2B are perspective views of the coin batch insertion device according to the embodiment of the present invention.

FIGS. 3A and 3B are perspective views illustrating components of the coin batch insertion device according to the embodiment of the present invention.

FIG. 4 is a perspective view illustrating a configuration of a coin batch insertion device according to another embodiment of the present invention.

FIG. 5 is a cross-sectional view illustrating a state where an inner peripheral wall of a cylindrical portion, an outer peripheral wall of a rotor, and a floor surface portion according to the embodiment of the present invention are inclined.

FIG. 6 is a perspective view of a rotor support portion of the coin batch insertion device according to the embodiment of the present invention.

FIG. 7 is a perspective view illustrating an engagement state between the rotor and the rotor support portion of the coin batch insertion device according to the embodiment of the present invention.

FIGS. 8A to 8C are diagrams illustrating eccentric states of the rotor of the coin batch insertion device according to the embodiment of the present invention.

FIG. 9 is a perspective view of a coin counting machine that uses the coin batch insertion device according to the embodiment of the present invention.

DESCRIPTION OF EMBODIMENTS

Hereinafter, one of embodiments of the present invention will be described with reference to the drawings.

FIG. 1 is a cross-sectional view of a main part of a coin batch insertion device 1 according to an embodiment of the present invention. FIGS. 2A and 2B are perspective views of the coin batch insertion device according to the embodiment of the present invention, FIG. 2A is the perspective view from the top, and FIG. 2B is the perspective view from the bottom. FIGS. 3A and 3B are perspective views illustrating components of the coin batch insertion device 1 according to the embodiment of the present invention, FIG. 3A is the perspective view from the bottom, and FIG. 3B is the perspective view from the top.

The coin batch insertion device 1 according to the embodiment of the present invention includes a cylindrical portion 4, a rotor 5, a rotor support portion 6, a floor surface portion 7, a driving motor 8, and a base portion 9. The cylindrical portion 4 is provided with a coin insertion port 2 to which coins in a denomination-mixed state can be inserted as a batch. The floor surface portion 7 is provided with a coin dropping hole 7*a* through which only a single coin can be dropped at one time. Further, a space among an inner peripheral wall of the cylindrical portion 4, an outer peripheral wall of the rotor 5, and the floor surface portion 7 serves as a coin retaining portion. The base portion 9 is provided with a coin passage 9*a* at a portion corresponding to a lower side of the coin dropping hole 7*a* of the floor surface portion 7, and an outlet of the coin passage 9*a* serves as a coin feeding port 3. In addition, the base portion 9 is provided with a control means (not illustrated) configured to control an operation of the device, such as an operation of the driving motor 8, and a coin identifying means (not illustrated) configured to determine a denomination of the coin passing through the coin passage 9*a*. The rotor 5 is driven to rotate by the driving motor 8 fixed to the base portion 9 via the rotor support portion 6. A coin contact portion 5*a* made of a rubber band material, etc. is provided at the outer peripheral wall of the rotor 5.

First, the operation of the coin batch insertion device 1 will be briefly described.

The coins inserted into the coin insertion port 2 drop between the inner peripheral wall of the cylindrical portion 4 and the outer peripheral wall of the rotor 5 by an inclination of an upper part of the rotor 5 and a centrifugal force caused by rotation of the rotor 5. The coins dropping between the inner peripheral wall of the cylindrical portion 4 and the outer peripheral wall of the rotor 5 are turned in to an erect state, and are conveyed along the inner peripheral wall of the cylindrical portion 4 while being maintained in the erect state by a frictional force between the coin and the coin contact portion 5*a* of the rotor 5 in accordance with the rotation of the rotor 5. The coins conveyed along the inner peripheral wall of the cylindrical portion 4 drop into the coin dropping hole 7*a* when being conveyed up to the top of the coin dropping hole 7*a*. The coin in the middle of dropping blocks the subsequent coin while the coin is dropping into the coin dropping hole 7*a*, and only the rotor 5 idles. The subsequent coin drops into the coin dropping hole 7*a* immediately after the immediately previous coin has completely dropped into the coin dropping hole 7*a*, or rotates one more time and waits for the next chance.

Further, the coin dropping into the coin dropping hole 7*a* passes through the coin passage 9*a* and is fed out from the coin feeding port 3. Here, when the coin passes through the coin passage 9*a*, genuineness or counterfeitness, and denomination of the passing coin is identified by a coin identifying means (not illustrated). A result of the identification performed by the coin identifying means (not illustrated) is used for counting of the coins or sorting of the coins, etc. according to an application of the coin batch insertion device 1.

In addition, the coin batch insertion device 1 has a function to automatically solve clogging of coins caused when a plurality of coins overlap one another at the time of rotating the rotor 5. When the rotating rotor 5 receives an external force generated by the clogging of coins, this function allows the rotation center of the rotor 5 to automatically move in a direction opposite to a direction in which the clogging occurs so as to release a compressive force and an adhesive force caused by the clogging coins, thereby automatically solving the clogging of coins. This function is implemented not by directly driving the rotor 5 using the driving motor 8 but by driving the rotor 5 via the rotor support portion 6. Details of a configuration and an operation of the rotor support portion 6 will be described later.

Next, more details of configurations and functions of major components will be described.

The cylindrical portion 4 is a cylindrical member whose upper portion is closed. The coin insertion port 2 having a size and a shape suitable for allowing a batch of coins to be inserted therethrough is provided at an upper part of the cylindrical portion 4. In the coin batch insertion device 1 of this example, the coin insertion port 2 is provided at a location where a coin does not directly enter the coin dropping hole 7*a* at the time of inserting the coin while avoiding the position above the coin dropping hole 7*a* of the floor surface portion. This is because the clogging of coins is likely to occur when the coin directly enters the coin dropping hole 7*a* at the time of inserting the coin.

As illustrated in FIG. 4, it is also possible to consider a configuration in which the large coin insertion port 2 is provided at a center of an upper portion of the cylindrical portion 4, which is different from the configuration of the coin batch insertion device 1 according to this embodiment. In this configuration, an eaves portion 4*a*, configured to prevent an inserted coin from directly entering the coin dropping hole 7*a*, is provided at a portion of the cylindrical portion 4 which corresponds to the position above of the coin dropping hole 7*a*.

The rotor 5 is a member having a shape in which a roof formed in a truncated-cone shape is attached to a cylinder. An inclination angle of a conical surface at an upper portion of the rotor 5 needs to be set to at least a degree that enables the inserted coin received by the conical surface to flow between the inner peripheral wall of the cylindrical portion 4 and the outer peripheral wall of the rotor 5 under the presence of the centrifugal force generated by the rotation of the rotor 5. In addition, a height of the outer peripheral wall of the rotor 5 needs to be set to at least a degree that enables the coin flowing between the inner peripheral wall of the cylindrical portion 4 and the outer peripheral wall of the rotor 5 to be conveyed along the inner peripheral wall of the cylindrical portion 4 while being maintained in the erect state.

Further, the outer peripheral wall of the rotor 5 is provided with the coin contact portion 5*a* made of the rubber band material. The coin contact portion 5*a* needs to be configured to generate the frictional force at a degree that enables the conveyance of the coin using the frictional force therebetween, and further, the idleness of only the rotor 5 when the coins are blocked. It is possible to use a suitable material other than the rubber band material for the coin contact portion 5*a* as long as the material generates such a frictional force. In addition, the coin contact portion 5*a* can be also configured to be integrated with the rotor 5 when the material that generates such a frictional force is used as a material to form the rotor 5.

In addition, three engagement protrusions 5*b* are provided near an outer circumference of a bottom portion of the rotor 5. The three engagement protrusions 5*b* are configured to be engaged with engagement holes 6*b*, which are provided near a distal end portion of each arm of the rotor support portion 6 to be described later, and are arranged at equal intervals.

The floor surface portion 7 is a member that supports the coin flowing between the inner peripheral wall of the cylindrical portion 4 and the outer peripheral wall of the rotor 5. The floor surface portion 7 is provided with the coin dropping hole 7*a* through which only the single coin can drop at one time at the portion corresponding to a bottom a gap between the cylindrical portion and the rotor. The coin dropping hole 7*a* has a slit shape and is configured such that a length of a short side thereof is larger than a thickness of a single coin which is the thickest, and is smaller than a thickness of two coins which are the thinnest, and a length of a long side thereof is larger than a diameter of a coin which is the largest, and is smaller than twice a diameter of a coin which is the smallest. In addition, the floor surface portion 7 may be integrated with the base portion 9.

FIG. 5 is a cross-sectional view illustrating a state where the inner peripheral wall of the cylindrical portion 4, the outer peripheral wall of the rotor 5, and the floor surface portion 7 of the coin batch insertion device 1 according to the embodiment of the present invention are inclined. In the coin batch insertion device 1 according to the embodiment, the inner peripheral wall of the cylindrical portion 4, the outer peripheral wall of the rotor 5, and the floor surface portion 7 are configured to be inclined as illustrated in FIG. 5. To be specific, both the inner peripheral wall of the cylindrical portion 4 and the outer peripheral wall of the rotor 5 are inclined toward the center portion, and the floor surface portion 7 is inclined to descend toward the center portion. This configuration allows the coin that is being conveyed between the inner peripheral wall of the cylindrical portion 4 and the outer peripheral wall of the rotor 5 to be in a state of leaning on the outer peripheral wall of the rotor 5. When the coin is set to be in the state of leaning on the outer peripheral wall of the rotor 5 in this manner, the coin easily contacts the coin contact portion 5*a*, and the coin is smoothly conveyed along the inner peripheral wall of the cylindrical portion 4.

FIG. 6 is a perspective view of the rotor support portion 6 of the coin batch insertion device 1 according to the embodiment. The rotor support portion 6 is a member having a shape in which the arms extending in three directions from a central portion thereof. A hole 6*a*, configured to fix a rotation shaft of the driving motor 8, is provided at the central portion of the rotor support portion 6.

One of the arms extending in the three directions of the rotor support portion 6 is a reference arm 61 formed to be integrated with the central portion. The other two arms are additional arms 62 which are attached using a rotation shaft 62*a* such that a root portion thereof is rotatable in the horizontal direction near the center portion of the rotor support portion 6. An initial position of the additional arms 62 is set in a state where the distal end portions of the respective arms are arranged at equal intervals. Further, the additional arm 62 is provided with an initial position biasing means configured to bias the additional arm 62 to the initial position. In the coin batch insertion device 1 according to the embodiment, a tension spring 63 is used as the initial position biasing means. The tension spring 63 has one end that is attached to a side surface of the additional arm 62 near the distal end portion and the other end that is attached to the central portion integrated with the reference arm 61. The tension springs 63 are attached to the both side surfaces of the additional arm 62 one by one. The additional arm 62 is biased to the initial position by the two tension springs 63 attached to the additional arm 62.

The engagement holes 6*b*, configured to be engaged with the engagement protrusions 5*b* provided at the bottom portion of the rotor 5, are provided near the distal end portions of the respective arms of the rotor support portion 6. The engagement hole 6*b* has a slit shape to be long in a center direction thereof. Thus, the engagement protrusion 5*b* of the rotor 5 to be engaged with the engagement hole 6*b* can move in the center direction and an outer circumferential direction along the engagement hole 6*b*.

FIG. 7 is a perspective view illustrating an engagement state between the rotor 5 and the rotor support portion 6. In an initial state, the engagement protrusion 5*b* of the rotor 5 is positioned at the center of the engagement hole 6*b* of the rotor support portion 6. When the rotor 5 is driven via the rotor support portion 6 in this manner, it is possible to automatically move the rotation center of the rotor 5 in the direction opposite to the direction in which the clogging occurs in a case where the rotor 5 receives the external force caused by the clogging of coins.

FIGS. 8A to 8C are diagrams illustrating eccentric states of the rotor 5 of the coin batch insertion device 1 according to the embodiment of the present invention, FIG. 8A illustrates a state where the clogging of coins occurs at the left side so that the rotor is eccentric to the right, FIG. 8B illustrates a state where the clogging of coins occurs at the upper side so that the rotor is eccentric to the lower side, and FIG. 8C illustrates a state where the clogging of coins occurs at the lower right side so that the rotor is eccentric to the upper left side.

In the initial state where the clogging of coins does not occur, the engagement protrusion 5*b* of the rotor 5 is positioned at the center of the engagement hole 6*b* of the rotor support portion 6. When the clogging of coins occurs, the external force is applied to the rotor 5 in the center direction from a location where the clogging of coins occurs. Thus, the engagement protrusions 5*b* of the rotor 5, which are engaged with the engagement holes 6*b* of the arms 61 and 62 on a side where the clogging of coins occurs when seen from the center, move in the center direction. On the contrary, the engagement protrusions 5*b* of the rotor 5, which are engaged with the engagement holes 6*b* of the arms 61 and 62 on a side where the clogging of coins does not occur when seen from the center, move in the outer circumferential direction. This movement of the engagement protrusion 5*b* of the rotor 5 is possible since the additional arm 62 can freely rotate about the rotation shaft 62*a*.

Since the movement of the engagement protrusion 5*b* of the rotor 5 is possible in this manner, the rotor 5 becomes eccentric in the direction opposite to the location where the clogging of coins occurs when seen from the center. Further, the compressive force and the adhesive force, caused by the clogging coins, are released by the eccentricity of the rotor 5, and the clogging of coins is automatically solved. Thereafter, when the clogging of coins is solved and the external force is not applied to the rotor 5 in the center direction, the initial state is recovered due to the action of the tension spring 63 attached to the additional arm 62.

This function of solving the clogging of coins using the rotor support portion 6 passively works without requiring an additional source of motive power, and the rotor support portion 6 automatically returns after solving the clogging of coins. Thus, it is possible to suppress the probability of causing failure. Incidentally, the number of the additional arms 62 of the rotor support portion 6 is set to two in the embodiment, but may be set to three or more.

Next, a method of solving clogging of coins by controlling the driving motor 8 will be described. The coin batch insertion device 1 according to the embodiment includes a current detecting means (not illustrated) which is configured to detect a current flowing in the driving motor 8. When clogging of coins occurs in the middle of driving of the driving motor 8 and a state is formed where the clogging of coins is not solved even using the above-described function of solving the clogging of coins, the rotation of the rotor 5 is weakened and the current flowing in the driving motor 8 increases. The occurrence of the clogging of coins is detected by detecting such an increase of the current using the current detecting means (not illustrated). When the occurrence of the clogging of coins that is not solved is detected, the control means (not illustrated) of the coin batch insertion device 1 performs control to reversely drive the driving motor 8, and then, to cause the driving motor 8 to return to normal rotation. However, when the clogging of coins is not solved even with such control, that is, when the occurrence of the clogging of coins is detected right after performing the control to cause the driving motor 8 to return to the normal rotation, the control means (not illustrated) stops the operation of the device so that the clogging of coins is manually solved.

Next, control of the coin batch insertion device 1 according to the embodiment will be described. The coin batch insertion device 1 performs feeding of inserted coins by rotating the rotor 5, that is, driving the driving motor 8. It is possible to use either a manual method or an automatic method as a method of controlling start and stop of driving of the driving motor 8. As the method of manually starting and stopping the driving of the driving motor 8, it is possible to consider control to instruct the start and stop of the driving of the driving motor 8 using a drive instructing means (not illustrated) by providing the drive instructing means (not illustrated) such as a button and switch in the device body. On the other hand, as the method of automatically starting and stopping the driving of the driving motor 8, it is possible to consider control to start the driving of the driving motor 8 when insertion of coins is detected by an inserted coin detecting means (not illustrated) by providing the inserted coin detecting means (not illustrated) and a fed coin detecting means (not illustrated), such as a magnetic sensor and an optical sensor, in the device body, and to stop the driving of the driving motor 8 when feeding of the coin is not detected by the fed coin detecting means (not illustrated) for a certain period of time. In addition, it is also possible to consider a method of manually performing an instruction to start the driving of the driving motor 8 and automatically performing the stop of the driving. In this case, it is possible to consider control in which the start of driving of the driving motor 8 is instructed using a drive instructing means (not illustrated), and thereafter, the driving of the driving motor 8 is stopped when feeding of coins is not detected by a fed coin detecting means (not illustrated) for a certain period of time.

Finally, a device using the coin batch insertion device 1 according to the embodiment will be described.

FIG. 9 is a perspective view of a coin counting device 10 that uses the coin batch insertion device 1 according to the embodiment of the present invention. This coin counting device 10 is configured such that a coin discharge unit 11 is provided immediately below the coin feeding port 3 of the coin batch insertion device 1 according to the embodiment. The counting of coins, the denomination determination and the genuine or counterfeit coin determination are performed using the coin identifying means (not illustrated) provided in the base portion 9 of the coin batch insertion device. The coin discharge unit 11 includes a lower discharge port 11*a*, a side discharge port 11*b*, and a counterfeit coin discharging means 11*c* such that a genuine coin is discharged through the lower discharge port 11*a*, and a coin determined as a counterfeit coin by the coin identifying means (not illustrated) is sent to and discharged through the side discharge port 11*b* by the counterfeit coin discharging means 11*c*. As output of a result of the counting in the coin counting device 10, it is possible to consider a configuration in which the result is transmitted to an external device or a configuration in which a counting result display unit is provided in the device body. In this manner, the coin batch insertion device 1 according to the embodiment has the structure of feeding coins by dropping the coins to the bottom, and thus, it is possible to arrange any necessary unit immediately below the coin batch insertion device 1. Thus, it is possible to implement the compact coin counting device which does not require a large space in the horizontal direction by employing the coin batch insertion device 1.

In addition, it is also possible to provide a coin sorting means and a coin storage unit immediately below the coin batch insertion device 1 according to the embodiment as a coin receiving device that stores coins for each denomination.

According to the above-described coin batch insertion device 1 according to the embodiment, it is possible to feed the coin at high speed. In addition, since the coin batch insertion device 1 has an extremely simple structure, it is possible to expect a stable operation, and commercialization thereof can be obtained at low cost. Furthermore, the coin batch insertion device 1 has the structure of feeding the coin by dropping the coin to the bottom, and thus, can be configured to be more compact than a device using the conventional hopper technique or belt-conveying technique which requires a large space in the horizontal direction.

Although one of the embodiments of the present invention has been described as above, the coin batch insertion device of the present invention is not limited to the embodiments. A suitable configuration can be employed as long as satisfying the configuration described in the claims.

REFERENCE SIGNS LIST

1 coin batch insertion device
2 coin insertion port
3 coin feeding port
4 cylindrical portion
4*a* eaves portion
5 rotor
5*a* coin contact portion
5*b* engagement protrusion
6 rotor support portion
6*a* driving motor rotation shaft fixing hole
6*b* engagement hole
61 reference arm
62 additional arm
7 floor surface portion
7*a* coin dropping hole
8 driving motor
9 base portion
9*a* coin passage
10 coin counting device
11 coin discharge unit
C coin

The invention claimed is:

1. A coin batch insertion device that separates and feeds a plurality of inserted coins, inserted as a batch, one by one, the coin batch insertion device comprising:

a cylindrical portion;

a rotor arranged inside the cylindrical portion;

and a floor surface including a coin dropping hole wherein the inserted coins are fed by conveying the coins, maintained in an erect state, between an inner peripheral wall of the cylindrical portion and an outer peripheral wall of the rotor along the inner peripheral wall of the cylindrical portion using rotation of the rotor and dropping the coins into the coin dropping hole one by one.

2. The coin batch insertion device according to claim 1, wherein the inner peripheral wall of the cylindrical portion and the outer peripheral wall of the rotor are inclined toward a center portion, and the floor surface portion is inclined to descend toward the center portion.

3. The coin batch insertion device according to claim 1, wherein a rotation center of the rotor moves in a direction opposite to a location where clogging of the inserted coins occurs when the clogging of the inserted coins occurs.

4. The coin batch insertion device according to claim 3, further comprising:

a driving motor; and a rotor support portion, wherein the rotor support portion is configured of a central portion to which a rotation shaft of the driving motor is fixed and three or more arms extending from the central portion, one of the arms is a reference arm which is integrated with the central portion, the other arms are additional arms which are attached to the central portion to be rotatable and biased to be at specific positions when an external force is not applied, engagement holes each of which has a slit shape that is long in a center direction are provided near distal end portions of the respective arms, and engagement protrusions, configured to be engaged with the engagement holes, are provided at a bottom portion of the rotor.

5. A coin counting device that counts a number of a plurality of inserted coins, inserted as a batch, the coin counting device comprising:

a cylindrical portion;

a rotor arranged inside the cylindrical portion;

a floor surface including a coin dropping hole; and a coin counting means arranged at a downstream side of the coin dropping hole, wherein the inserted coins maintained in an erect state are conveyed between an inner peripheral wall of the cylindrical portion and an outer peripheral wall of the rotor along the inner peripheral wall of the cylindrical portion using rotation of the rotor, and are dropped into the coin dropping hole to be fed out one by one such that the fed-out inserted coins are counted by the coin counting means.

* * * * *